US006648669B1

(12) United States Patent
Kim et al.

(10) Patent No.: US 6,648,669 B1
(45) Date of Patent: Nov. 18, 2003

(54) ELECTRICAL CONNECTION WITH SEQUENTIAL DISCONNECT

(75) Inventors: Bobby Kim, Ann Arbor, MI (US); Takashi Takagishi, Plymouth, MI (US)

(73) Assignee: Yazaki North America, Canton, MI (US)

( * ) Notice: Subject to any disclaimer, the term of this patent is extended or adjusted under 35 U.S.C. 154(b) by 0 days.

(21) Appl. No.: 10/196,823

(22) Filed: Jul. 17, 2002

(51) Int. Cl.[7] ..... H01R 13/627
(52) U.S. Cl. ..... 439/357
(58) Field of Search ..... 439/352, 353, 439/357, 358

(56) References Cited

U.S. PATENT DOCUMENTS

| | | | | |
|---|---|---|---|---|
| 4,131,328 A | | 12/1978 | Minar et al. | 439/106 |
| 4,634,204 A | * | 1/1987 | Detter et al. | 439/347 |
| 4,915,648 A | | 4/1990 | Takase et al. | 439/490 |
| 5,174,787 A | * | 12/1992 | Shirai et al. | 439/489 |
| 5,434,752 A | | 7/1995 | Huth et al. | 361/798 |
| 5,531,605 A | | 7/1996 | Taniuchi et al. | 439/157 |
| 5,860,819 A | | 1/1999 | Northey et al. | 439/108 |
| 5,910,027 A | * | 6/1999 | Wayt et al. | 439/489 |
| 5,913,691 A | | 6/1999 | Clark et al. | 439/157 |
| 5,993,238 A | * | 11/1999 | Kudo et al. | 439/352 |
| 6,071,151 A | | 6/2000 | Igarashi | 439/660 |
| 6,116,938 A | * | 9/2000 | Myer et al. | 439/353 |
| 6,325,648 B1 | | 12/2001 | Bilezikjian et al. | 439/157 |
| 6,332,799 B1 | * | 12/2001 | Torii et al. | 439/352 |
| 6,354,860 B1 | * | 3/2002 | Miller et al. | 439/352 |
| 6,435,895 B1 | * | 8/2002 | Fink et al. | 439/352 |

* cited by examiner

*Primary Examiner*—Tulsidas Patel
(74) *Attorney, Agent, or Firm*—Young & Basile P.C.

(57) ABSTRACT

A locking and unlocking structure for terminal connector housings of the type used in vehicle electrical systems, especially where terminals in the housings are unmated in staggered order. An axial locking member on one housing engages a locking receptacle on the other housing in a single-step locking connection, but can only be released through a series of alternating unlocking steps and connector separation steps in which the unmating of pilot and primary terminals is separated by one of the unlocking steps. The mechanical delay between the terminal unmating steps prevents arcing in high voltage or high current circuits.

15 Claims, 6 Drawing Sheets

ELECTRICAL CONNECTION WITH SEQUENTIAL DISCONNECT

FIELD OF THE INVENTION

This invention relates to electrical connectors which require a sequence of operations to effect a disconnection.

BACKGROUND OF THE INVENTION

Push-to-lock electrical connectors are commonly used in automotive wiring harnesses and the like. With the advent of higher voltage and higher current vehicle electrical systems in which positive and negative power terminals are contained in the same housing in close proximity to one another or to terminals from other circuits, it is becoming increasingly common to use connectors with multi-step terminal mating and unmating sequences to prevent arcing. Using first-to-mate/last-to-unmate "primary" terminals and last-to-mate/first-to-unmate "pilot" terminals, for example with the primary terminals on a power circuit and the pilot terminals on a control circuit, the risks of electrical arcing and shock are prevented. The staggered mate/unmate sequence is typically accomplished by making the primary terminals longer and/or by offsetting them relative to the pilot terminals. When male and female connectors with such terminals are coupled and uncoupled, the electrical circuit is made and broken only after the power terminals are fully mated and unmated, preferably while the terminals are still safely within the confines of the coupled connector housings.

Vehicle connector housings also frequently include multi-step locking and unlocking features to ensure positive mechanical and electrical connection, and to prevent unintended separation. The classes of structures commonly known as "CPA" (connector position assurance) and "TPA" (terminal position assurance) devices are good examples.

It has been known to combine multi-step terminal and multi-step connector functions, for example as in U.S. Pat. No. 6,325,648, in which a lever assist structure on the outside of the connector housings is arranged to complement the staggered make and break sequence of primary and pilot terminals.

A potential disadvantage of multi-step connector locking structures is the feel of the locking motion, which is generally not smooth and uninterrupted. This can result in partial locking of the mechanism due to failure of the person mating the connectors to feel the difference between full and partial connection.

SUMMARY OF THE INVENTION

The present invention is a connector housing locking method and mechanism especially, although not exclusively, useful for multi-step terminal connections. Locking the connector housings is a single, smooth, uninterrupted step; once mated, the locking connection is protected against unintended release. Unlocking the connector housings requires a series of independent release steps alternating between manipulation of the locking connection and relative movement of the connector housings in the separation direction. This multi-step unlocking procedure is especially useful with multi-step terminal disconnect arrangements, as the release steps can be timed to ensure a staggered terminal disconnection with a positive mechanical delay between the unmating of the terminals.

In the preferred form, the connector locking mechanism is a one-step insertion, multi-step extraction lock arm arrangement, in which the locking connection is made in the axial insertion direction of the connector housings. Unlocking the connector housings requires stepwise vertical operation of the lock arm alternating with incremental, stepwise withdrawal of the connector housings. In a further preferred form, the locking mechanism is an axially-mating tip of a flexible, cantilevered lock arm extending from one connector housing, and a receptacle on the outside of the mating connector housing for receiving the locking tip in one smooth locking step. The receptacle defines a step-wise unlocking path for the locking tip as the lock arm is sequentially pressed down and the connector housings are sequentially pulled apart. This locking/unlocking mechanism can be operated by one hand if the connector housing with the receptacle is mounted on a fixed object.

These and other features and advantages of the invention will be apparent from the description below in view of the accompanying drawings.

DETAILED DESCRIPTION OF THE INVENTION

Figure 1:
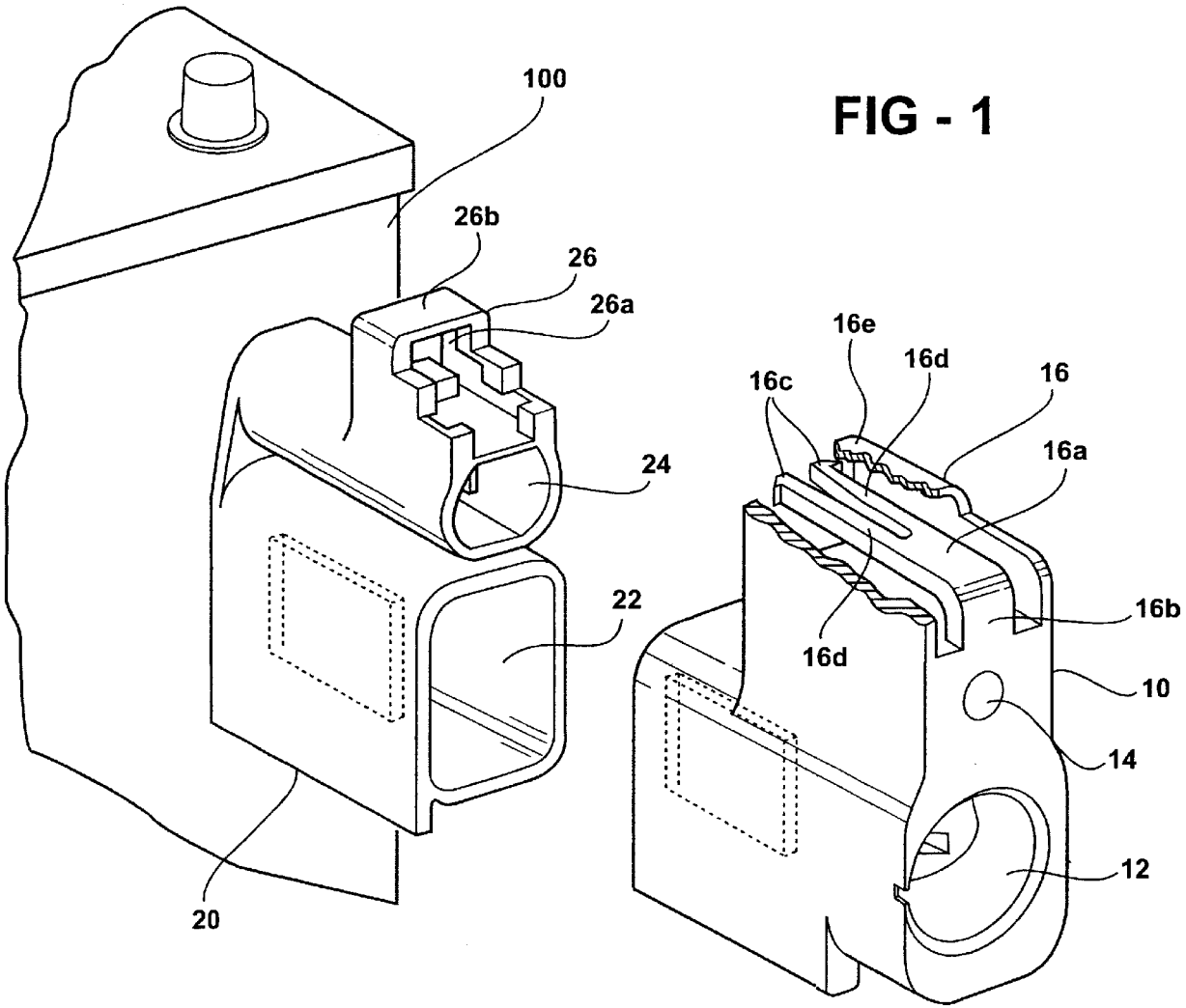
FIG. 1 is a perspective view of two connector housings of the type having terminals that mate and unmate in staggered fashion, the connector housings having mating, exterior connector locking structure according to the invention.

Referring to FIG. 1, a male connector housing 10 and female connector housing 20 are illustrated prior to mating.

The connector housings are of generally known type, usually formed by molding from suitable insulative dielectric materials, for example polymers such as nylon, acetal resin, polypropylene, and others known to those skilled in the art. Male connector housing 10 includes a primary terminal chamber 12 housing one or more primary electrical terminals (FIG. 1B), and a pilot terminal chamber 14 housing one or more pilot electrical terminals (FIG. 1B). Wire-terminated primary and pilot terminals made to connect and disconnect in staggered fashion with mating terminals in a separate connector are known to those skilled in the art, and can take many forms. The form of these terminals and the style of connector housing in which they are mounted are not critical to the present invention, which can be applied to most known connector systems and terminal arrangements. The invention can even be applied to connectors whose terminal sets mate and unmate simultaneously, although the most advantage can be obtained by pairing the inventive locking mechanism with staggered terminal unmating arrangements, as in the present preferred example.

Female housing 20 has a primary terminal chamber 22 and a pilot terminal chamber 24 whose respective terminals (FIG. 1B) mate and unmate with those in male housing 10 in a known, multi-step or staggered fashion. Their relative lengths and/or their respective positions fore and aft in their housings result in the primary terminals mating first and unmating second, and the pilot terminals mating last and unmating first. The pilot terminals may be positive, negative, or on a separate circuit, and are referred to as "pilot" simply as a convention denoting their order of mating. Some may refer to the first-mating terminals as "pilot" terminals; the name given the terminals is not important.

Figure 1A:
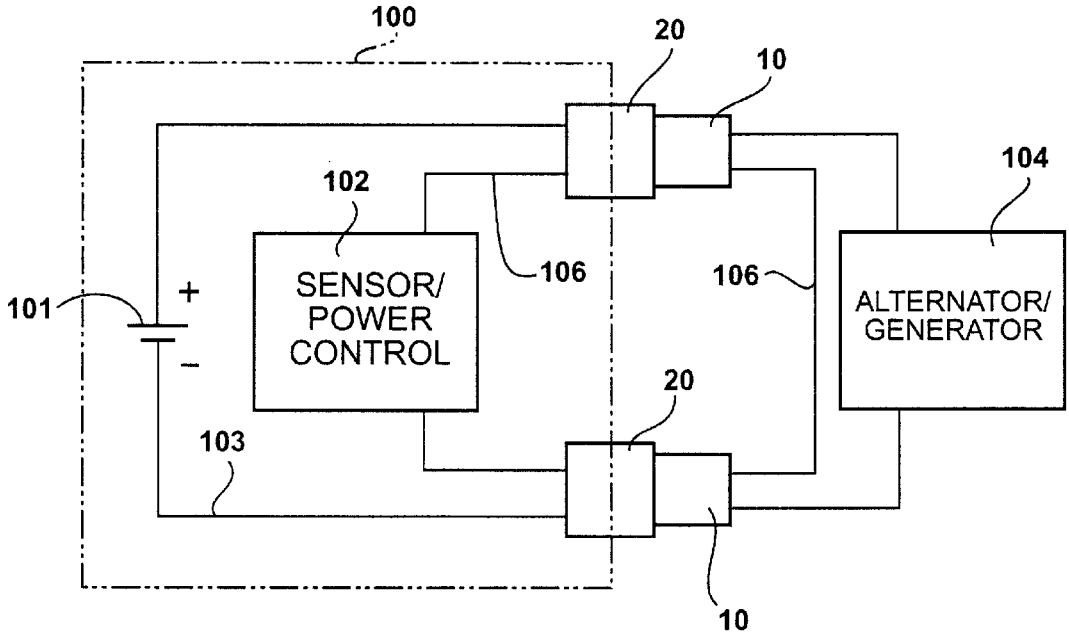
FIG. 1A is a schematic circuit diagram of a multi-connector battery charging system using the connectors of FIG. 1, in which each of the connector housings includes both power and control terminals.
Figure 1B:
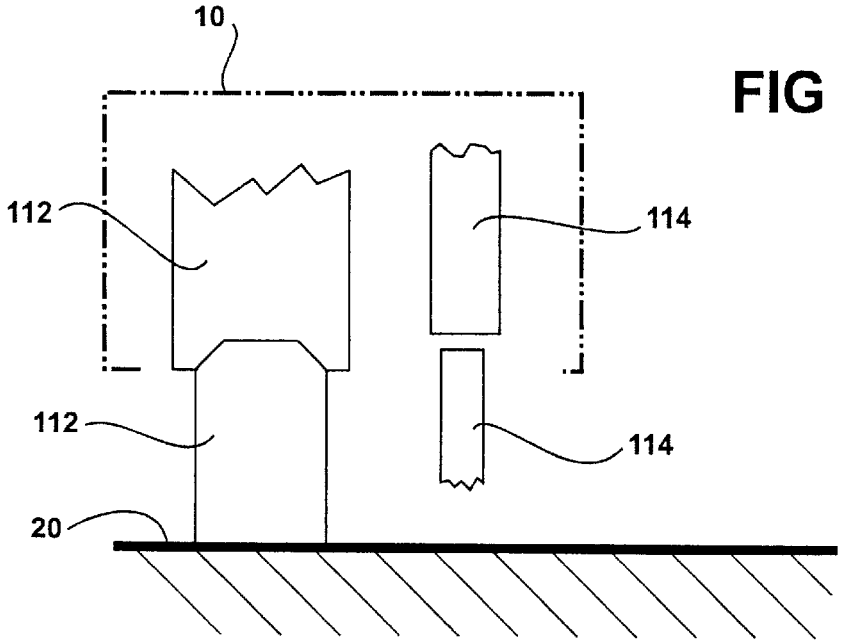
FIG. 1B is a schematic representation of a staggered primary/pilot terminal mating and unmating arrangement for the connectors of FIGS. 1 and 1A.

FIGS. 1A and 1B illustrate one possible circuit and terminal setting in which a connector locking mechanism according to the invention is useful. FIG. 1A represents a battery charging circuit for a high voltage (e.g., 42-volt) vehicle system, in which battery 100 includes a control sensor 102 for sensing when the powered "primary" terminals of positive and negative charging connectors 10 from alternator/generator 104 are mated and unmated with their counterpart "primary" terminals in battery connectors 20. Control sensor 102, for example a relay that reads whether the power circuit is open or closed and controls the battery accordingly, is coupled to "pilot" terminals that are last-to-mate when the connector housings are coupled. When the pilot terminals mate they close circuit 106 to signal that power-carrying primary terminals are already connected. Control sensor 102 then connects the load 101 of battery 100 to the alternator/generator via the primary terminals on circuit 103, allowing the battery to be charged. When the battery is disconnected from the alternator/generator by unplugging connectors 10 and 20, the break in circuit 106 caused by the separation of the first-to-unmate pilot terminals signals the control sensor to disconnect the battery from the last-to-unmate primary terminals before they are unmated, preventing high voltage arcing that can damage the terminals and housings.

FIG. 1B illustrates a staggered terminal arrangement for connector housings 10 and 20, in which the primary terminals 112 are longer and/or offset in their respective housings so as to mate first and unmate last, while the pilot terminals 114 are shorter and/or offset to mate last and unmate first when the housings are pulled apart.

It should be understood that while pilot and primary terminals in the present example refer to sets of terminals connected to parallel power and control circuits, it is also known to use the primary/pilot mating and unmating sequence for positive and negative power terminals in the same connector, or for sets of different-voltage terminals in the same connector, for example arranging a low voltage set of primary terminals to mate first and unmate last and a high voltage set of pilot terminals to mate last and unmate first. The present invention works with all such variations on the pilot/primary mating sequence.

It will also be recognized that the labels "male" and "female" as applied to the connector housings is arbitrary, as some will label them depending on the type of terminal the housings carry, others on the form of the housings themselves. In the present example, male and female as applied to the connector housings 10 and 20 refers to the male and female portions of the connector locking structure they carry. Male connector housing 10 carries the "male" portion 16 of the connector locking structure according to the invention. Female housing 20 carries the corresponding "female" portion 26. As housings 10 and 20 are designed to mate in an axial push-fit, so are connector locking structures 16 and 26.

Referring back to FIG. 1, male locking structure 16 comprises a cantilevered lock arm 16*a*, secured at a base end 16*b* to housing 10 and having a free, locking end 16*c* in the form of a pair of flexible, spaced, barbed fingers 16*d*. Locking end 16*c* is covered by a protective shroud 16*e* that makes accidental contact with the locking end difficult. Arm 16*a* is made from a flexible material, preferably molded from the same polymer as housing 10 along with the rest of lock structure 16.

Female lock structure 26 comprises a receptacle formed on the exterior of female housing 20 for receiving lock arm 16*a* as the housings are mated.

Receptacle 26 has a staircase-like series of interior stops defining a single-step locking connection for arm 16*a*, and defining a multi-step connector unlocking and terminal unmating sequence that the lock arm must follow in order to separate the housings and their terminals. The uppermost aperture 26*a* receives end 16*c* of lock arm 16*a* in an axial locking fit, covered and protected by shroud 26*b* from accidental contact. Shroud 16*e* on male housing 10 complements shroud 26*b* by overlying and optionally extending the protective coverage of the locking connection when the housings are mated.

Figure 2:
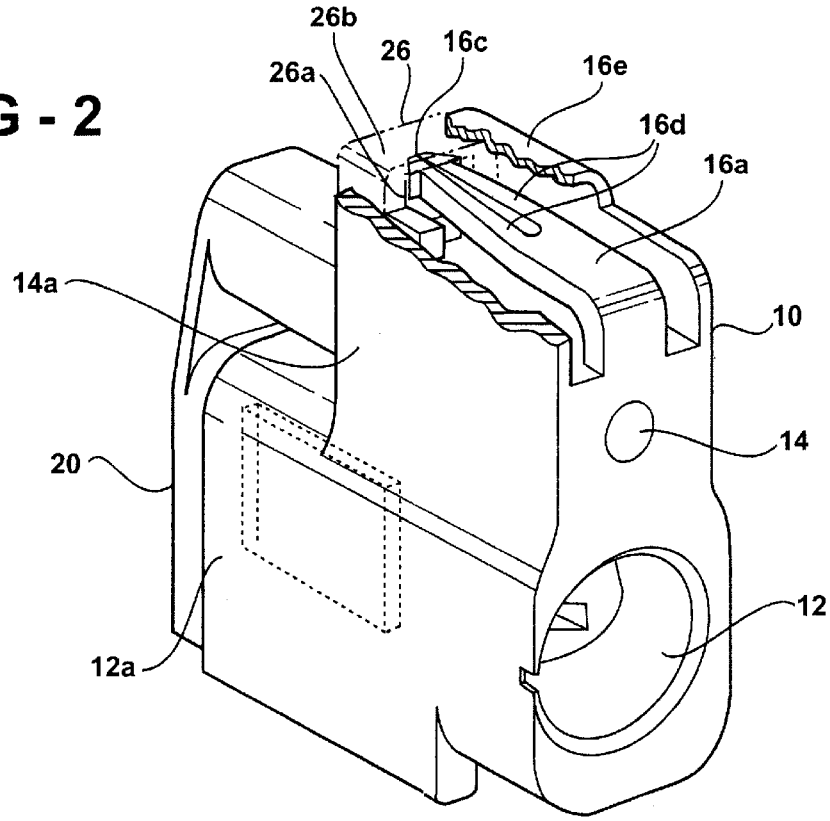
FIG. 2 shows the connector housings of FIG. 1 in a partially-mated condition, with a portion of the male locking structure cut away and a portion of the female locking structure in phantom to show the initial engagement of their locking portions.
Figure 3:
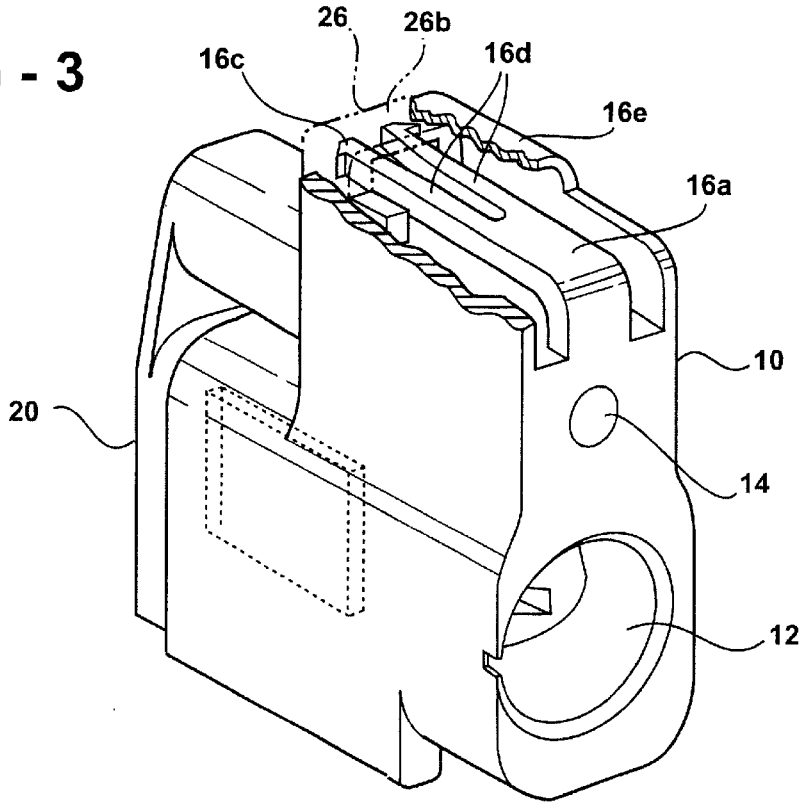
FIG. 3 is similar to FIG. 2, but with the connector housings in a fully mated condition and the locking step completed.

FIG. 2 shows housings 10 and 20 partially mated. The cutaway and phantom portions of the shrouds allow a clear view of the initial contact of lock arm end 16*c* with aperture 26*a*. Barbed fingers 16*d* are set wider than aperture 26*a*, but have angled tips that force them together as end 16*c* is forced against the aperture, finally allowing them through as shown in FIG. 3. At the partially mated stage of FIG. 2, the exterior walls 12*a* and 14*a* of primary and pilot terminal chambers 12 and 14 on housing 10 are telescoped over the exterior walls of the primary and pilot chambers 22 and 24 of housing 20, thereby enclosing the terminals before they begin to mate.

FIG. 3 shows the housings 10 and 20 fully mated, again with portions of the shrouds removed to expose the now-complete locking connection between lock arm 16*a* and receptacle 26. Once locking ends 16*c* of barbed fingers 16*d* are forced completely through aperture 26*a*, they return to their spaced apart relationship with the rear surfaces of the barbed portions against the rear of the aperture, preventing withdrawal. In this locked condition neither the locking connection nor the housings 10 and 20 can be pulled apart.

It will be clear from FIGS. 1 through 3 that the locking connection as the housings are joined occurs in one smooth, uninterrupted motion, naturally following the push-together fit of the housings. No extra locking steps are needed, no additional structure needs to be operated. This is an advantage to the person connecting the housings, reducing the chance of a partially mated connector set.

Figure 4:
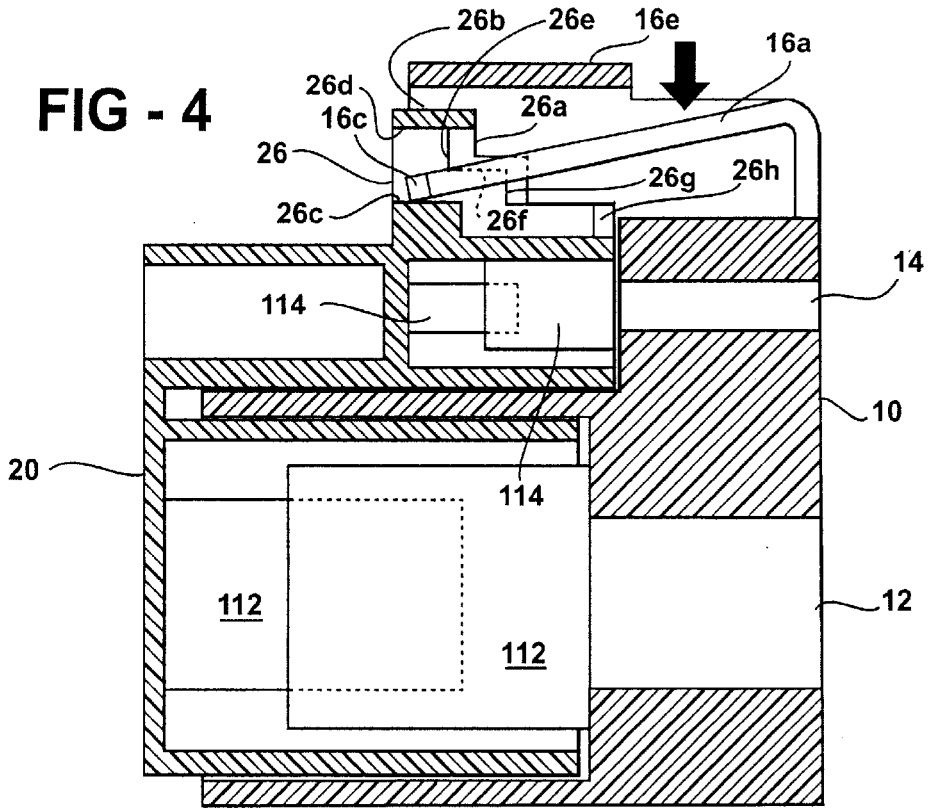
FIG. 4 is a side elevation view of the still fully mated connector housings, but with the male locking structure pressed down from its fully-locked position to a primary unlocking position.

It is virtually impossible for barbed locking ends 16*c* of fingers 16*d* to be accidentally squeezed together to permit withdrawal of the lock arm from its locking connection with the receptacle. The protective shrouding of the locking connection hinders even intentional access to the locking end of lock arm 16*a*. The procedure to begin unlocking and separating the connectors is accordingly shown in FIG. 4, where the first step involves pressing the exposed portion of arm 16*a* down toward housing 10. The free, locking end 16*c* of the flexible arm is accordingly forced down in receptacle 26, until it reaches stop 26*c*. This is the primary unlocking condition, in which locking end 16*c* drops below aperture 26*a* into alignment with the next level of the staircase-like path defined by vertical stops 26*d* and 26*f* and horizontal (axial) stops 26*e*, 26*g*, and 26*h*. When forced against stop 26*c*, locking end 16*c* is in a primary unlocking position, aligned with horizontal stop 26*e* and capable of being withdrawn from receptacle 26 until locking end 16*c* abuts stop 26*g*.

Figure 5:
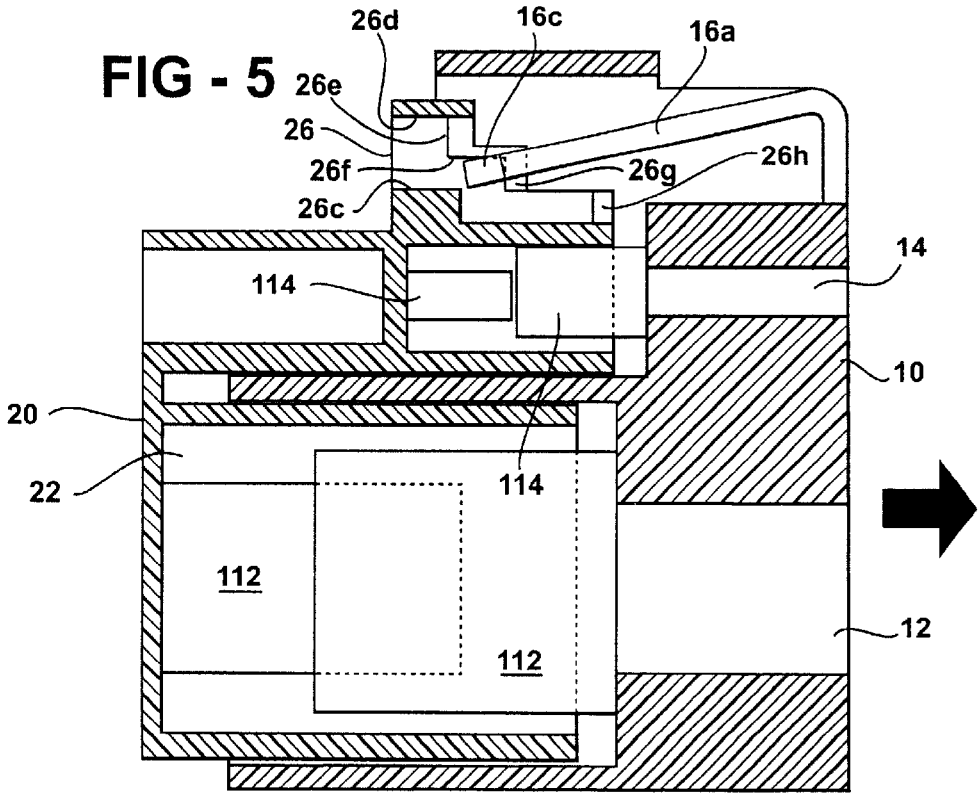
FIG. 5 is similar to FIG. 4, but with the male connector housing pulled while in the primary unlocking position to a primary unmating position in which the pilot terminals are disconnected.

This is the first step in the connector unlocking process, which next proceeds as shown in FIG. 5.

FIG. 5 shows mate connector housing 10 partially uncoupled from female housing 20 in the primary unmating position, in which locking end 16*c* abuts horizontal stop 26*g* to prevent further withdrawal, and in which the last-to-mate pilot terminals 114 have become the first to unmate. The primary terminals 112 remain mated at this point. In the circuit example of FIG. 1A, the control sensor 102 senses the break in the pilot terminals, disconnecting the battery load from the primary terminals.

Figure 6:
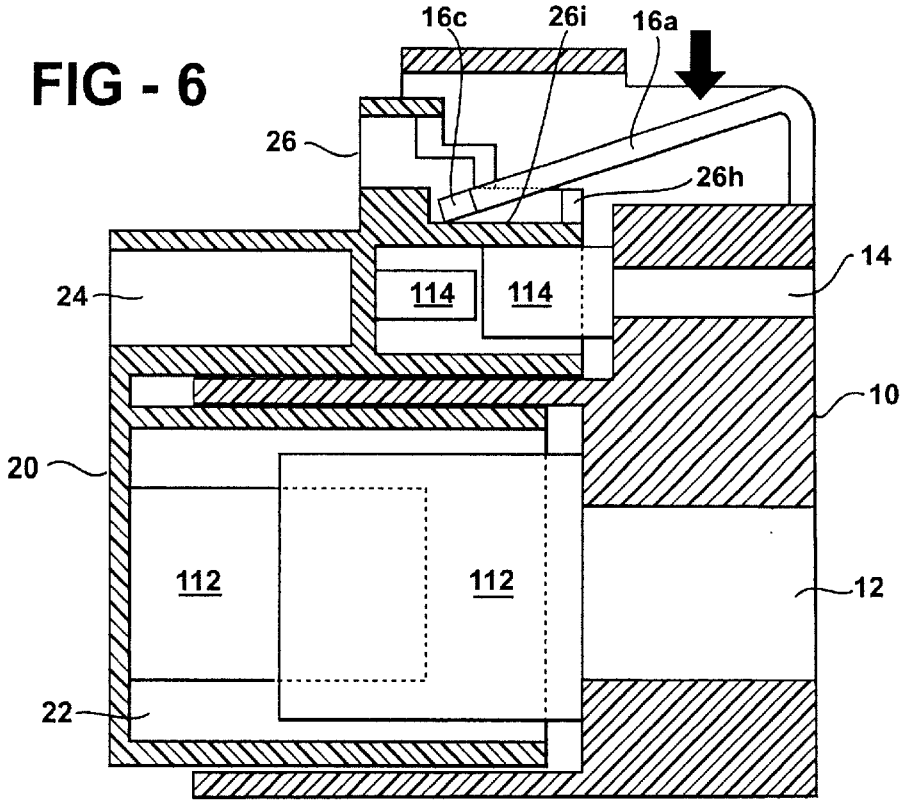
FIG. 6 is similar to FIG. 5, but with the male locking structure pressed down from the primary unmating position to a secondary unlocking position.

In FIG. 6, lock arm 16*a* is pressed down again to place the connector housings in the secondary unlocking condition, in which the housings are ready to be pulled apart another notch. Locking end 16*c* is lowered into alignment with the last, lowermost horizontal stop 26*h* in the staircase-like path defined by receptacle 26, limited in its downward travel by the "floor" 26*i* of the receptacle.

Figure 7:
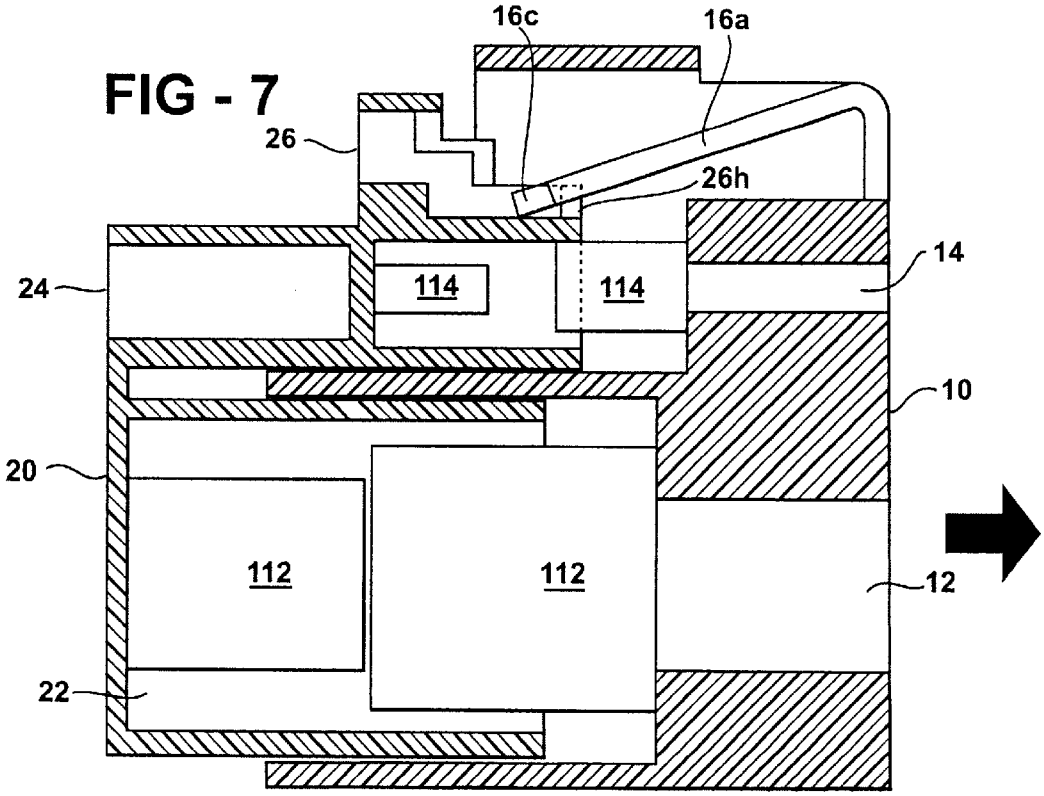
FIG. 7 is similar to FIG. 6, but with the male connector housing pulled from the secondary unlocking position to a secondary unmating position in which the primary terminals are disconnected.

FIG. 7 shows the connector housings 10 and 20 uncoupled further in the secondary unmating condition, where locking end 16*c* of the lock arm abuts stop 26*h*, and the previously de-energized primary terminals 112 are now unmated within the confines of the still-overlapping terminal chambers. The multi-step terminal disconnect sequence is now complete, and the housings are ready to be completely separated.

Figure 8:
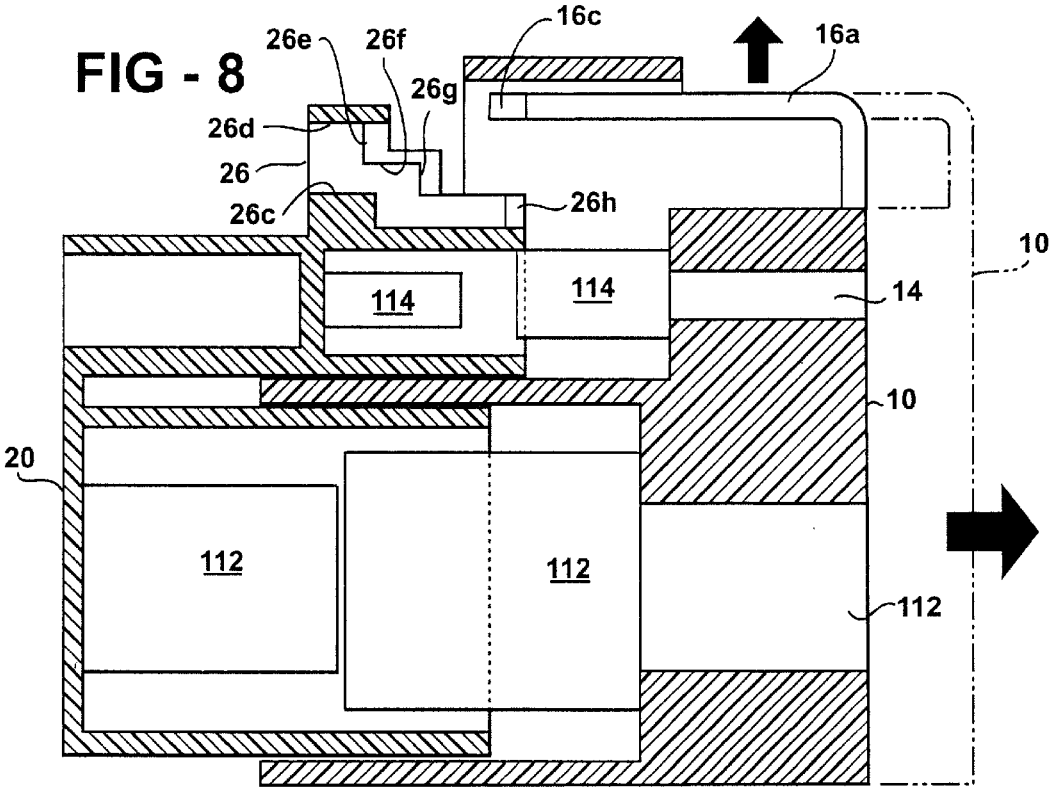
FIG. 8 is similar to FIG. 7, but with the male locking structure raised from the secondary unmating position to a fully unlocked position in which the connector housings can be fully separated as shown.

FIG. 8 shows lock arm 16*a* being released from the secondary unmating position of FIG. 7, such that end 16*c* returns to its relaxed position above stop 26*h* under the natural tension in the cantilevered lock arm. Connector housings 10 and 20 can now be pulled free of one another without risk of arcing or shock.

Figure 9:
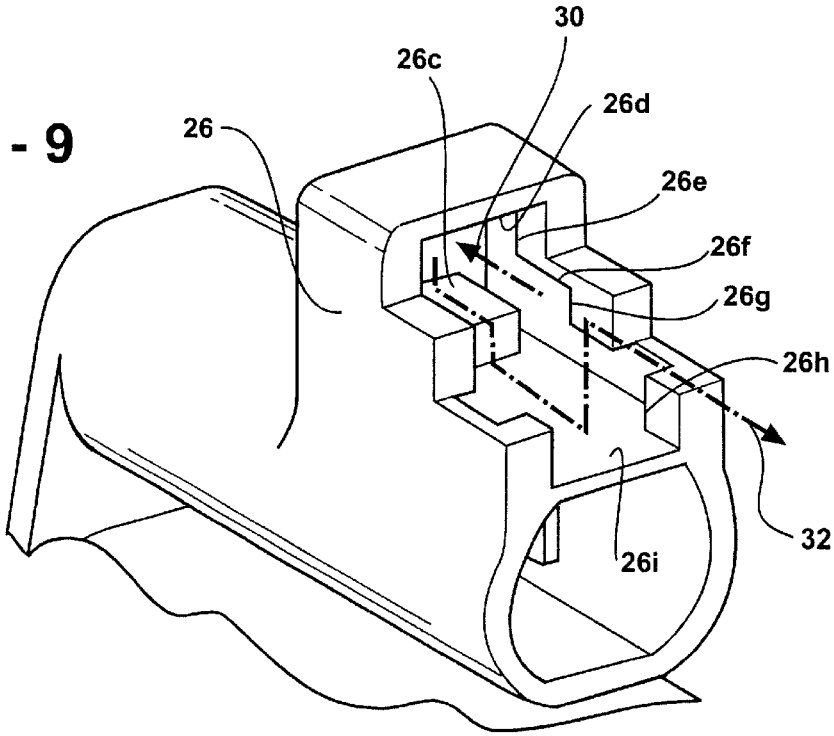
FIG. 9 is a perspective view of the interior of the female locking receptacle, schematically illustrating the single-step locking and multiple-step unlocking method of the locking structure of FIGS. 1 through 8.

FIG. 9 illustrates the single-step locking motion of FIG. 3 and the multiple unmating and unlocking steps of FIGS. 4 through 8 in schematic fashion, with arrows following the path of the locking end 16*c* of the male lock arm through female connector locking receptacle 26. The single-step locking connection is depicted by arrow 30. The multiple-step unlocking/unmating procedure is represented by serpentine arrow 32 proceeding through the staircase-like series of stops 26*d*, 26*e*, 26*f*, 26*g*, and 26*h*.

The foregoing description is of a preferred example of the invention, and is not intended to limit the invention to that example. While the illustrated example is a parallel, high voltage power and control circuit connection, the inventive locking/unlocking scheme can be used with any set of high or low voltage terminals of the vehicle electrical system type in which a staggered make and break sequence is complemented by the single-step locking and multi-step unlocking procedure. It will be understood that the vertical orientation of the connector housings, and the reference to pressing the lock arm 16*a* "down", are relative and merely a convenient orientation and terminology for describing the invention. The connector housings can be oriented in any direction, and "down" refers to the direction from the lock arm's rest position toward the connector housing. The connector housings can both be free-hanging on the ends of suitable wires or cables, or one can be fastened to a fixed object while the other is mated and unmated. If the female connector housing is fixed, the disconnect sequence can be accomplished and the connectors unmated with one hand. It will also be understood by those skilled in the art that the finer details of the connector locking structure and the unlocking/unmating path defined through the receptacle can vary from the specific example shown without departing from the scope of the invention. The reference to the lock arm as "male" and the locking receptacle as "female" is for descriptive rather than limiting purpose; the lock arm need not be a cantilever arm but may take other forms where the locking end is vertically operable after an initial axial connection. The terms "horizontal" and "vertical" used to orient the description herein are not absolute, and are relative to the axial connector mating direction.

Accordingly, we claim:

1. A single-step locking and multiple-step unlocking structure on axially-mating terminal connector housings of the type used in vehicle electrical systems, comprising:

a lock arm on a first of the connector housings, the lock arm having a locking end adjustable vertically downward toward the first connector housing;

a locking receptacle on a second of the connector housings, the locking receptacle having a protected locking aperture spaced from the second connector housing to lockingly receive the locking end of the lock arm in an axial insertion direction corresponding to the axially-mating direction of the connector housings, the locking aperture and the locking end of the lock arm mating in a single step to form an axial locking connection between them when the connector housings and their terminals are fully mated;

a multi-directional release path in the locking receptacle defined by a series of vertical and axial stops located below and before the protected locking aperture, the protected locking aperture opening vertically downward to the release path such that the locking end of the lock arm can be lowered out of the locking connection with the locking aperture and worked stepwise vertically and axially through the release path to separate the connector housings in multiple steps.

2. The connector housing locking structure of claim 1, wherein the release path defines a series of alternating vertical and horizontal release steps.

3. The connector housing locking structure of claim 1, wherein the connector housings include mating primary terminals and mating pilot terminals, the primary terminals arranged to mate first and unmate last, and the pilot terminals arranged to mate last and unmate first, and wherein at least one of the multiple steps in the release path corresponds to the unmating of the pilot terminals, and at least one of the multiple steps in the release path corresponds to the unmating of the primary terminals.

4. The connector housing locking structure of claim 3, wherein vertical steps in the release path are connector unlocking steps, and horizontal steps in the release path are terminal unmating steps.

5. The connector housing locking structure of claim 3, wherein the primary terminals are unmated prior to the lock end of the locking arm leaving the release path.

6. The connector housing locking structure of claim 5, wherein the connector housings include mating terminal chambers enclosing the primary and pilot terminals when the housings are at least partially mated, and wherein the connector housings remain at least partially mated until the lock end of the locking arm leaves the release path.

7. The connector housing locking structure of claim 1, wherein the axial locking connection is axially irreversible.

8. The connector housing locking structure of claim 1, wherein the axial locking connection is protected by a portion of the locking receptacle.

9. The connector housing locking structure of claim 1, wherein the lock arm is a cantilever arm attached to the first connector housing and having a flexible locking end vertically spaced from the first connector housing.

10. A single-step locking and multiple-step unlocking structure on axially-mating terminal connector housings of the type used in vehicle electrical systems to mate and unmate terminals in staggered fashion, comprising:

a first connector housing having a primary terminal and a pilot terminal;

a second connector housing having a primary terminal and a pilot terminal, the second connector housing being axially mateable with the first connector housing, the primary terminals being arranged to mate first and the pilot terminals being arranged to mate last when the connector housings are mated, and the pilot terminals being arranged to unmate first and the primary terminals being arranged to unmate last when the connector housings are unmated;

the first connector housing having an axial locking member, and the second connector housing having an axial locking receptacle for receiving the axial locking member in a single-step axial locking connection after the first and second connector housings have been axially mated sufficiently to mate the primary terminals, the axial locking receptacle defining a multi-step release path for the axial locking member in which a first release step corresponds to the unmating of the pilot terminals and a second release step separated from the first release step by a mechanical delay corresponds to the unmating of the primary terminals.

11. The connector housing locking and unlocking structure of claim 10, wherein the single-step axial locking connection is irreversible, and the axial locking receptacle opens vertically downward to the release path.

12. The connector housing locking structure of claim 11, wherein the release path comprises a series of vertical and axial stops for the axial locking member defining alternating vertical and axial release steps, in which the vertical release steps are connector unlocking steps comprising movement of the axial locking member and the horizontal release steps are terminal unmating steps comprising partial separation of the connector housings, and further wherein one of the connector unlocking steps comprises the mechanical delay between the unmating of the pilot and primary terminals.

13. A method of uncoupling coupled electrical connectors of the type used in vehicle electrical systems, the connectors having primary and pilot terminals that unmate in staggered fashion as the connectors are uncoupled, comprising the following steps:

sequentially unlocking a locking element that locks the connectors in a coupled state, and partially uncoupling the connectors between sequential unlocking steps, until the primary and pilot terminals are unmated, and then fully uncoupling the connectors.

14. The method of claim 13, wherein the steps of partially uncoupling the connectors are mechanically timed to correspond to unmating of the pilot and primary terminals.

15. The method of claim 14, wherein the step of fully uncoupling the connectors is separated from the unmating of the primary terminals by an unlocking step.

* * * * *